US006789613B1

(12) United States Patent
Ozaki et al.

(10) Patent No.: US 6,789,613 B1
(45) Date of Patent: Sep. 14, 2004

(54) DOUBLE HEAT EXCHANGER FOR VEHICLE AIR CONDITIONER

(75) Inventors: Tatsuo Ozaki, Okazaki (JP); Satomi Muto, Nishikasugai-gun (JP); Takaaki Sakane, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/620,860

(22) Filed: Jul. 21, 2000

(30) Foreign Application Priority Data

Aug. 20, 1999 (JP) ..... 11-234271

(51) Int. Cl.[7] ..... F28D 7/10; F28D 1/06
(52) U.S. Cl. ..... 165/140; 165/132
(58) Field of Search ..... 165/140, 41, 135, 165/132

(56) References Cited

U.S. PATENT DOCUMENTS

| | | | | | |
|---|---|---|---|---|---|
| 4,651,816 | A | * | 3/1987 | Struss et al. | 165/140 |
| 4,947,931 | A | * | 8/1990 | Vitacco | 165/140 |
| 5,000,257 | A | * | 3/1991 | Shinmura | 165/140 |
| 5,033,540 | A | * | 7/1991 | Tategami et al. | 165/140 |
| 5,234,051 | A | * | 8/1993 | Weizenburger et al. | 165/140 |
| 5,526,873 | A | * | 6/1996 | Marsais et al. | 165/140 |
| 5,592,830 | A | * | 1/1997 | Baba et al. | 165/132 |
| 5,678,760 | A | * | 10/1997 | Muso et al. | 165/41 |
| 5,992,514 | A | * | 11/1999 | Sugimoto et al. | 165/135 |
| 6,173,766 | B1 | * | 1/2001 | Nakamura et al. | 165/140 |

FOREIGN PATENT DOCUMENTS

| | | | | |
|---|---|---|---|---|
| EP | 0855566 | | 7/1998 | |
| EP | 0928886 | | 7/1999 | |
| FR | 2682160 | | 4/1993 | |
| FR | 2709344 | | 3/1995 | |
| FR | 2726325 | | 5/1996 | |
| GB | 2113819 | * | 8/1983 | 165/140 |
| GB | 2262600 | * | 6/1993 | 165/140 |

OTHER PUBLICATIONS

2244 Research Disclosure Nov. (1994), No. 367, Emsworth, GB, entitled "Integral Radiator With Multiple Circuits".

Patent Abstracts of Japanese Publication No. 10103893, Publication Date: Apr. 24, 1998, Application Date: Jan. 10, 1997, Appl. No. 09003331, for "Heat Exchanger Apparatus".

* cited by examiner

*Primary Examiner*—Ljiljana Ciric
(74) *Attorney, Agent, or Firm*—Harness, Dickey & Pierce, PLC

(57) ABSTRACT

A double heat exchanger for a vehicle air conditioner has a first radiator for cooling engine coolant, a second radiator for cooling electronic-parts coolant for cooling electronic parts of the vehicle and a condenser disposed at an upstream air side of the first and second radiators. The condenser has a condenser core and a cooler through which refrigerant discharged from the condenser core flows. The second radiator is disposed opposite the cooler so that air having passed through the cooler passes through the second radiator. Therefore, a difference between a temperature of air passing through the second radiator and a temperature of electronic-parts coolant flowing through the second radiator is increased, and electronic-parts coolant is sufficiently cooled. As a result, the electronic parts are sufficiently cooled without increasing a size of the second radiator.

8 Claims, 9 Drawing Sheets

DOUBLE HEAT EXCHANGER FOR VEHICLE AIR CONDITIONER

CROSS REFERENCE TO RELATED APPLICATIONS

This application relates to and claims priority from Japanese Patent Application No. 11-234271 filed on Aug. 20, 1999, the contents of which are hereby incorporated by reference.

BACKGROUND OF THE INVENTION

1. Field of the Invention

The present invention relates generally to heat exchangers, and particularly to a double heat exchanger having plural heat exchangers such as a radiator and a condenser for a vehicle air conditioner. The present invention is suitably applied for a hybrid vehicle driven switchably by an engine and an electric motor, or driven mainly by the motor while using the engine for generation of electricity.

2. Related Art

Conventionally, a hybrid vehicle has an engine and an electric motor, and needs to cool the engine and electronic parts of the vehicle such as an inverter which controls the motor. Generally, engine coolant for cooling the engine is cooled by a radiator to have a temperature of 100–110° C. and lower. When the electronic parts are cooled by coolant, the coolant (hereinafter referred to as electronic-parts coolant) needs to be cooled by the radiator to have a temperature lower than that of engine coolant such as 60–70° C. and lower.

In a vehicle air conditioner having a refrigeration cycle, a maximum temperature of refrigerant is approximately 80–90° C., which is lower than that of engine coolant. Therefore, a condenser of the refrigeration cycle which condenses high pressure refrigerant in the cycle is disposed at an upstream air side of the radiator. A difference between a temperature of air having passed through the condenser and a temperature of electronic-parts coolant flowing into the radiator is smaller than a difference between a temperature of air having passed through the condenser and a temperature of engine coolant flowing into the radiator. Therefore, when electronic-parts coolant flowing through the radiator is heat-exchanged with air having passed through the condenser, electronic-parts coolant may be insufficiently cooled. As a result, the electronic parts may be insufficiently cooled by electronic-parts coolant. The electronic parts may be sufficiently cooled when an area of radiation of the radiator which cools electronic-parts coolant is increased. In such a case, however, a size of the radiator is increased.

SUMMARY OF THE INVENTION

In view of the foregoing problems, it is an object of the present invention to provide a heat exchanger which sufficiently cools a heat releasing member without increasing a size of the heat exchanger.

According to the present invention, a heat exchanger has first, second and third heat exchangers and is connected to first and second heat releasing members. The first heat exchanger performs heat exchange between a first fluid flowing through the first heat exchanger and air passing through the first heat exchanger to cool the first fluid. The first fluid cooled by the first heat exchanger is introduced into the first heat releasing member. The second heat exchanger performs heat exchange between the first fluid flowing through the second heat exchanger and air passing through the second heat exchanger to cool the first fluid to a temperature lower than that of the first fluid introduced into the first heat releasing member. The second heat exchanger discharges the first fluid cooled by the second heat exchanger toward the second heat releasing member. The third heat exchanger is disposed at an upstream air side of the first and second heat exchangers to perform heat exchange between a second fluid flowing through the third heat exchanger and air passing through the third heat exchanger. The second fluid has a temperature lower than that of the first fluid flowing through the first and second heat exchangers. At least a part of the second heat exchanger is disposed opposite a portion of the third heat exchanger which accommodates a downstream flow of the second fluid, so that air having passed through the portion of the third heat exchanger passes through the second heat exchanger.

When the third heat exchanger is a condenser, the second fluid has a lower temperature at a downstream side than at an upstream side in the third heat exchanger. Therefore, air having passed through the portion of the third heat exchanger which accommodates the downstream flow of the second fluid has a temperature lower than that of air having passed through the other portion of the third heat exchanger. As a result, a difference between a temperature of air passing through the second heat exchanger and a temperature of the first fluid flowing through the second heat exchanger is increased. Therefore, the first fluid flowing through the second heat exchanger is sufficiently cooled, and the second heat releasing member is sufficiently cooled by the first fluid without increasing a size of the second heat exchanger.

Preferably, the third heat exchanger has a condenser core which condenses a refrigerant of a refrigeration cycle and a cooler which cools the refrigerant discharged from the condenser core. At least a part of the second heat exchanger is disposed opposite the cooler so that air having passed through the cooler passes through the second heat exchanger. Since an amount of heat radiated from the cooler is smaller than that of the condenser core, a difference between a temperature of air passing through the second heat exchanger and a temperature of the first fluid flowing through the second heat exchanger is increased. As a result, the first fluid flowing through the second heat exchanger is sufficiently cooled.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

First Embodiment

Figure 1:
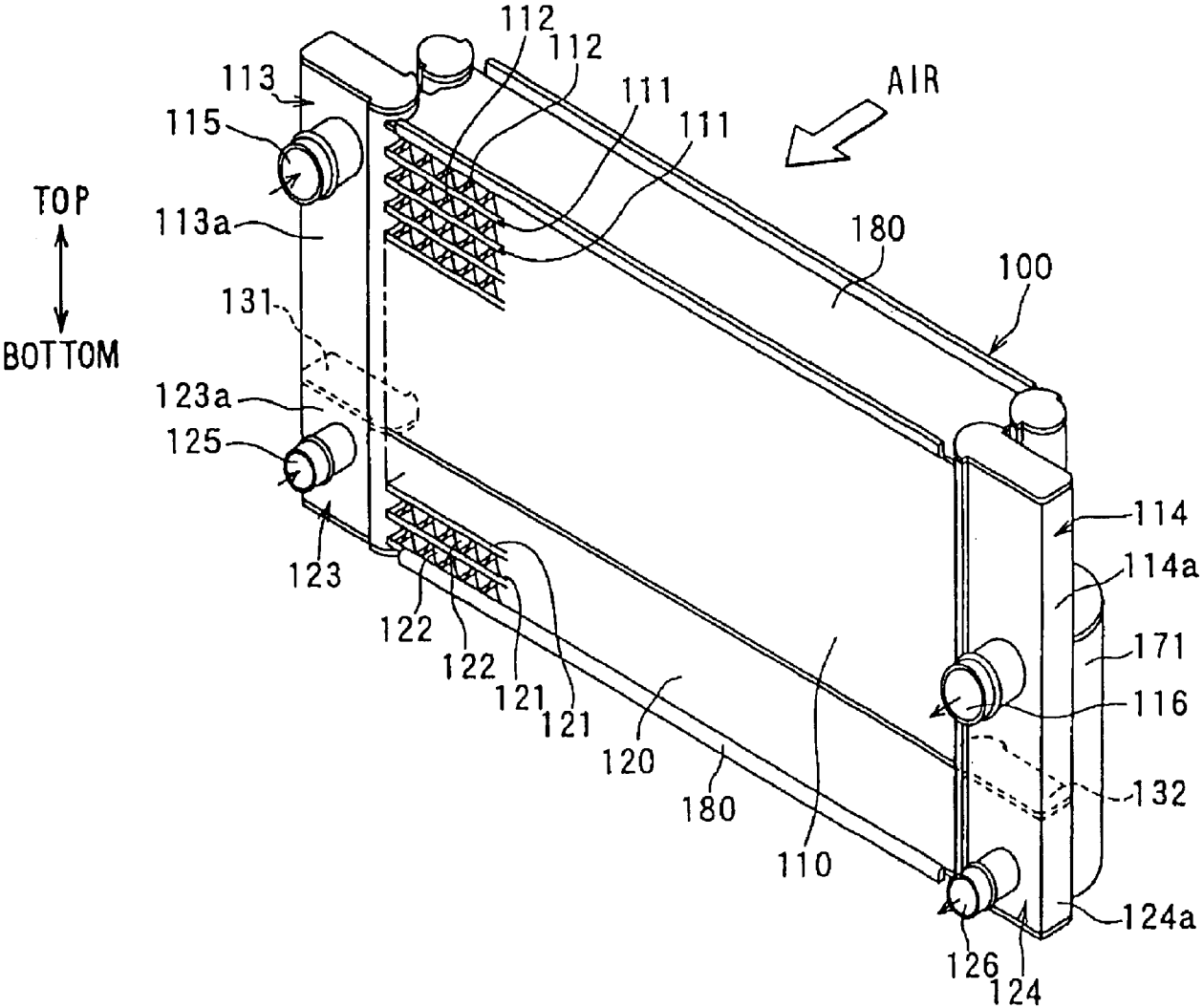
FIG. 1 is a schematic perspective view showing a double heat exchanger for a vehicle air conditioner according to a first preferred embodiment of the present invention.
Figure 2:
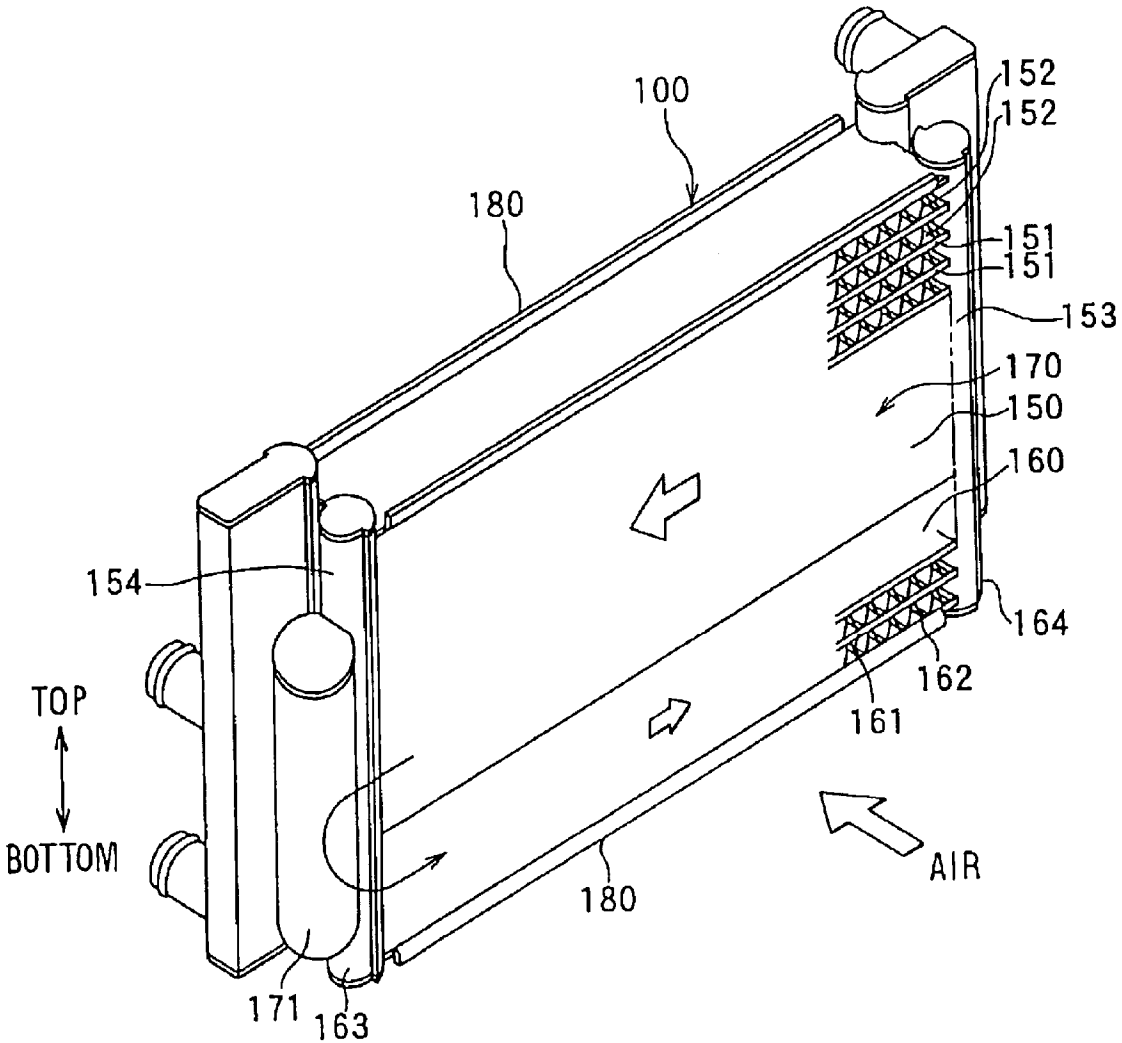
FIG. 2 is a schematic perspective view showing the double heat exchanger according to the first embodiment.

A first preferred embodiment of the present invention will be described with reference to FIGS. 1–4. In the first embodiment, the present invention is applied to a double heat exchanger 100 for an air conditioner for a hybrid vehicle. In FIG. 1, the heat exchanger 100 is viewed from a downstream air side with respect to air passing through the heat exchanger 100. In FIG. 2, the heat exchanger 100 is viewed from an upstream air side.

As shown in FIG. 1, the heat exchanger 100 has a first radiator 110 which performs heat exchange between engine coolant flowing into an engine 200 (FIG. 3) of the vehicle for cooling the engine 200 and air passing through the first radiator 110 so that engine coolant is cooled. The first radiator 110 has plural first radiator tubes 111 through which engine coolant flows, plural corrugated fins 112 each of which is disposed between adjacent first radiator tubes 111 for facilitating heat exchange between engine coolant and air, and first radiator inlet and outlet tanks 113, 114 respectively disposed at left and right flow-path ends of the first tubes 111 in FIG. 1 to communicate with the first tubes 111.

Engine coolant discharged from the engine 200 flows into the first radiator inlet tank 113 from an inlet 115 of the tank 113 and is distributed to each of the first radiator tubes 111. After being heat-exchanged with air to be cooled, engine coolant flowing through the first radiator tubes 111 is collected into the first radiator outlet tank 114 and is discharged toward the engine 200 through an outlet 116 of the tank 114.

The heat exchanger 100 also has a second radiator 120 which performs heat exchange between electronic-parts coolant for cooling electronic parts 210 of the vehicle and air passing through the second radiator 120 so that electronic-parts coolant is cooled, and discharges the cooled electronic-parts coolant toward the electronic parts 210. The second radiator 120 has plural second radiator tubes 121 through which electronic-parts coolant flows, plural corrugated fins 122 each of which is disposed between adjacent second radiator tubes 121 for facilitating heat exchange between electronic-parts coolant and air, and second radiator inlet and outlet tanks 123, 124 respectively disposed at left and right flow-path ends of the second radiator tubes 121 in FIG. 1 to communicate with the second radiator tubes 121.

Electronic-parts coolant discharged from the electronic parts 210 flows into the second radiator inlet tank 123 through an inlet 125 of the tank 123 and is distributed to each of the second radiator tubes 121. After being heat-exchanged with air to be cooled, electronic-parts coolant flowing through the second radiator tubes 121 is collected into the second radiator outlet tank 124 and is discharged toward the electronic parts 210 through an outlet 126 of the tank 124.

The first radiator inlet tank 113, the first radiator outlet tank 114, the second radiator inlet tank 123 and the second radiator outlet tank 124 respectively have tank bodies 113*a*, 114*a*, 123a and 124*a* each of which is formed into a pipe having a rectangular cross section. The first and second radiators 110, 120 are integrally formed through the tank bodies 113*a*, 114*a*, 123*a* and 124*a*. The tank body 113*a* is separated from the tank body 123a by a partition wall 131 disposed therebetween. The tank body 114*a* is separated from the tank body 124*a* by a partition wall 132 disposed therebetween. Therefore, a space inside the first and second radiators 110, 120 is partitioned by the partition walls 131, 132 into a space including the first radiator inlet and outlet tanks 113, 114 and a space including the second radiator inlet and outlet tanks 123, 124.

Figure 3:
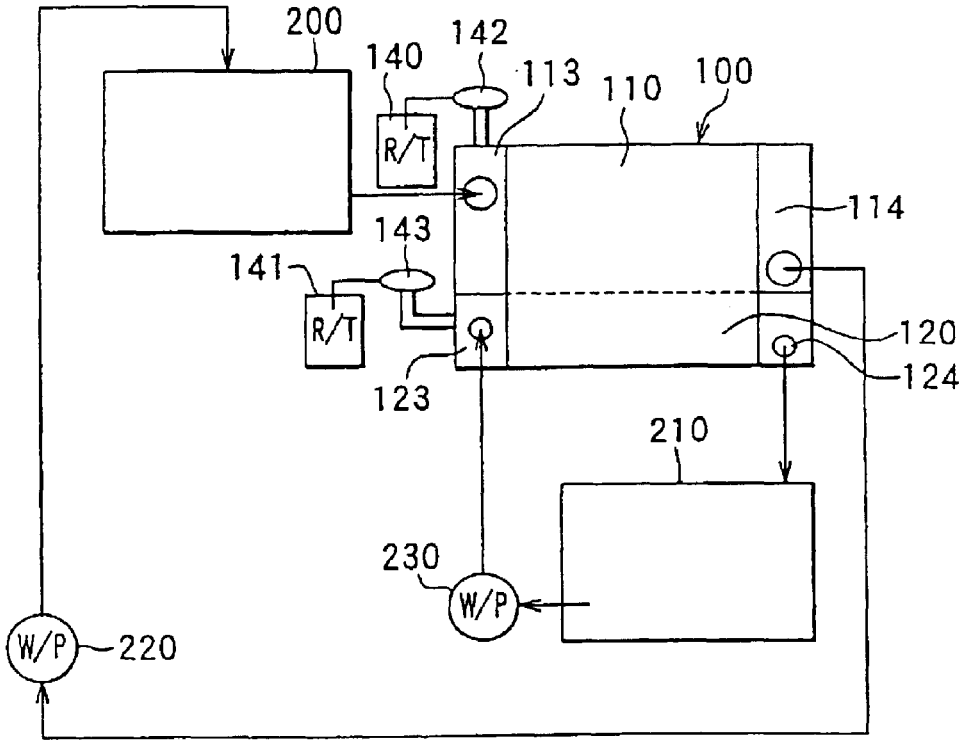
FIG. 3 is a block diagram showing a coolant circuit of the double heat exchanger according to the first embodiment.

As shown in FIG. 3, a first water pump 220 is driven by the engine 200 to make engine coolant circulate through the engine 200 and the first radiator 110. A second water pump 230 is electrically driven to make electronic-parts coolant circulate through the electronic parts 210 and the second radiator 120. A change in an amount of engine coolant in the first radiator 110 is absorbed by a first reserve tank 140. A change in an amount of electronic-parts coolant in the second radiator 120 is absorbed by a second reserve tank 141. The first radiator 110 is filled and refilled with engine coolant in the first reserve tank 140 through a first filler hole 142. The second radiator 120 is filled and refilled with electronic-parts coolant in the second reserve tank 141 through a second filler hole 143. Each of the first and second filler holes 142, 143 is closed by a well-known pressurizing radiator cap. In the first embodiment, engine coolant has the same composition as that of electronic-parts coolant, and water added with an ethylene glycol antifreeze solution is used as engine coolant and electronic-parts coolant.

As shown in FIG. 2, the heat exchanger 100 has a cooler-integrated condenser 170 disposed at an upstream air side of the first and second radiators 110, 120. The condenser 170 has a condenser core 150 which condenses high-pressure refrigerant in a refrigeration cycle of the air conditioner, and a cooler 160 which cools refrigerant discharged from the condenser core 150. In the condenser 170, refrigerant flows as indicated by arrows in FIG. 2. A temperature of refrigerant flowing through the condenser 170 is lower than that of engine coolant and electronic-parts coolant flowing through the first and second radiators 110, 120. When a temperature of air outside a passenger compartment of the vehicle is approximately 30° C., a temperature of refrigerant at an inlet of the condenser 170 is approximately 80–90° C., and an average temperature of refrigerant in the cooler 160 is approximately 45° C.

The condenser core 150 has plural condenser tubes 151 through which refrigerant flows, plural corrugated fins 152 each of which is disposed between adjacent condenser tubes 151 for facilitating heat exchange between refrigerant and air passing through the condenser 170 and first and second condenser tanks 153, 154 respectively disposed at right and left flow-path ends of the condenser tubes 151 in FIG. 2 to communicate with the condenser tubes 151. Refrigerant discharged from a compressor (not shown) of the refrigeration cycle flows into the first condenser tank 153 and is distributed to each of the condenser tubes 151. After being heat-exchanged with air to be cooled, refrigerant flowing through the condenser tubes 151 is collected into the second condenser tank 154 and is discharged toward the cooler 160.

The cooler 160 has plural cooler tubes 161 through which refrigerant flows, plural corrugated fins each of which is disposed between adjacent cooler tubes 161 and first and second cooler tanks 163, 164 respectively disposed at left and right flow-path ends of the cooler tubes 161 in FIG. 2 to communicate with the cooler tubes 161. Refrigerant flowing into the first cooler tank 163 is distributed to each of the cooler tubes 161. After being heat-exchanged with air to be cooled, refrigerant flowing through the cooler tubes 161 is collected into the second cooler tank 164 and is discharged toward a decompressor (not shown) of the refrigeration cycle.

The condenser core 150 and the cooler 160 are integrally formed through the first and second condenser tanks 153, 154 and the first and second cooler tanks 163, 164. A space inside the condenser core 150 and the cooler 160 is partitioned into a space including the first and second condenser tanks 153, 154 and a space including the first and second cooler tanks 163, 164 by a partition wall (not shown) disposed between the first condenser tank 153 and the second cooler tank 164 and a partition wall (not shown) disposed between the second condenser tank 154 and the first cooler tank 163. Further, a separator 171 is integrally brazed to the condenser 170. The separator 171 separates refrigerant from the second condenser tank 154 into liquid refrigerant and gas refrigerant and discharges liquid refrigerant into the first cooler tank 163. Excess refrigerant in the refrigeration cycle is also stored in the separator 171.

As shown in FIGS. 1 and 2, the first and second condenser tubes 111, 121, the condenser tubes 151 and the cooler tubes 161 are disposed to extend in parallel with each other in a longitudinal direction thereof and substantially perpendicular to an air flow direction. Further, a pair of side plates 180 extending in parallel with the tubes 111, 121, 151 and 161 are disposed across the tanks 113, 114, 123, 124, 153, 154, 163 and 164 for reinforcing the first and second radiators 110, 120 and the condenser 170.

Figure 4:
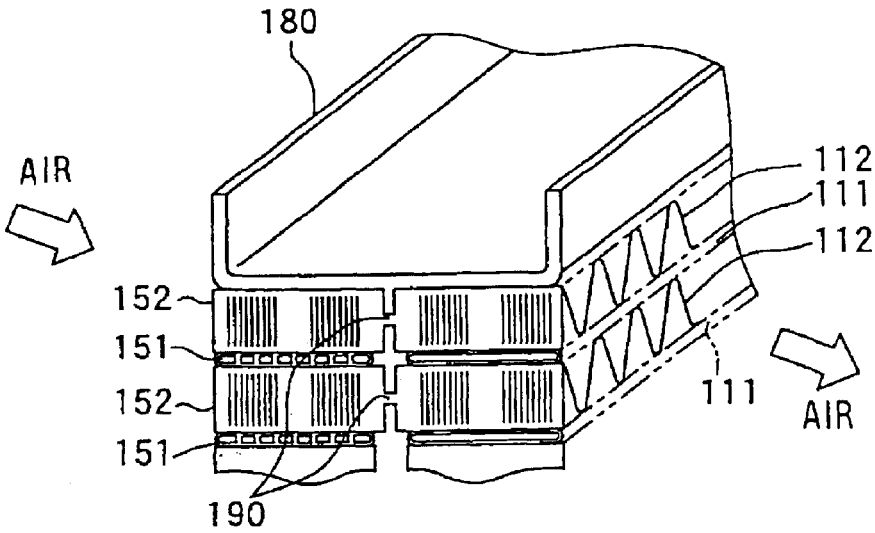
FIG. 4 is a schematic partial perspective view showing the double heat exchanger according to the first embodiment.

As shown in FIG. 4, each of the fins 112 of the first radiator 110 is integrally formed with each of the fins 152 of the condenser core 150 through a connection portion 190. Similarly, each of the fins 122 of the second radiator 120 is integrally formed with each of the fins 162 of the cooler 160 through the connection portion 190. Thus, the first and second radiators 110, 120 and the condenser 170 are integrally formed through the fins 112, 122, 152 and 162 and the side plates 180. Further, as shown in FIGS. 1 and 2, the second radiator 120 is disposed at an immediate downstream air side of the cooler 160 so that at least a part of the second radiator 120 is disposed opposite a portion of the condenser 170 which accommodates a downstream flow of refrigerant.

Generally, in a condenser through which refrigerant flows, refrigerant is more condensed at a downstream side to have a lower temperature than at an upstream side. Therefore, air having passed through a portion of the condenser which accommodates a downstream flow of refrigerant has a temperature lower than that of air having passed through the other portion of the condenser.

According to the first embodiment, the second radiator 120 is disposed at a downstream air side of the condenser 170 to be opposite the cooler 160, that is, the portion of the condenser 170 which accommodates a downstream flow of refrigerant. Therefore, a difference between a temperature of electronic-parts coolant flowing through the second radiator 120 and a temperature of air passing through the second radiator 120 is increased. As a result, electronic-parts coolant is sufficiently cooled by air to a lower temperature, and the electronic parts 210 are sufficiently cooled by electronic-parts coolant without increasing a size of the second radiator 120.

Refrigerant in the condenser core 150 is condensed and is cooled while radiating heat of condensation. Refrigerant in the cooler 160 is not condensed and is cooled while radiating sensible heat. Therefore, an amount of heat radiated from the cooler 160 is smaller than that of the condenser core 150. As a result, a temperature of air having passed through the cooler 160 is lower than that of air having passed through the condenser core 150. Therefore, a difference between a temperature of electronic-parts coolant flowing through the second radiator 120 and a temperature of air passing through the second radiator 120 is further increased, and a temperature of electronic-parts coolant is further decreased.

Further, in the first embodiment, the first and second radiators 110, 120 and the condenser 170 are integrally formed. Therefore, the first and second radiators 110, 120 and the condenser 170 are mounted to the vehicle in one mounting process, thereby improving a mounting efficiency thereof to the vehicle. Moreover, since the second radiator 120 is disposed at a downstream air side of the condenser 170, cooling performance of the condenser 170 is not affected by the second radiator 120. As a result, power consumption of the compressor is not increased.

Second Embodiment

Figure 5:
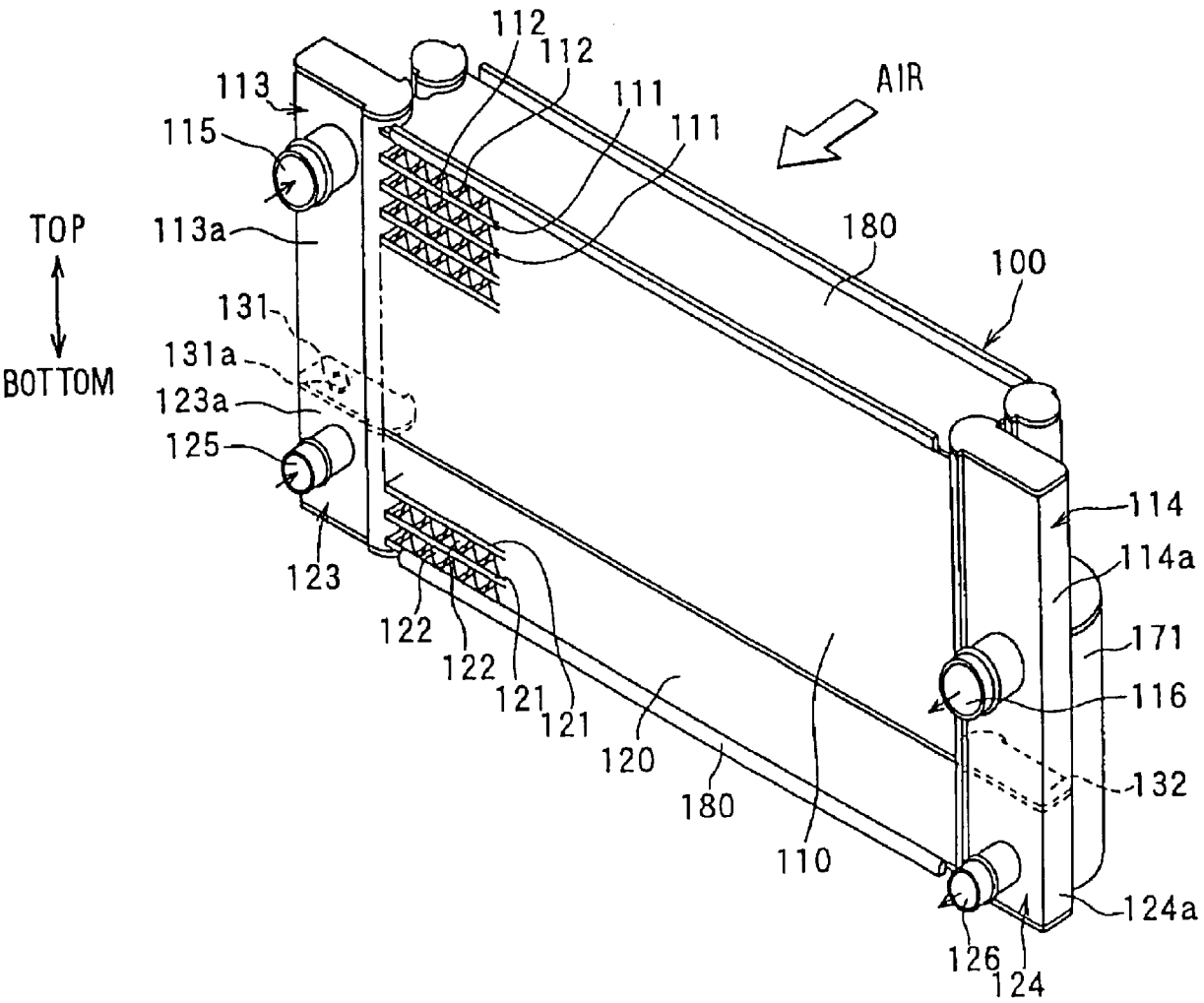
FIG. 5 is a schematic perspective view showing a double heat exchanger for a vehicle air conditioner according to a second preferred embodiment of the present invention.
Figure 6:
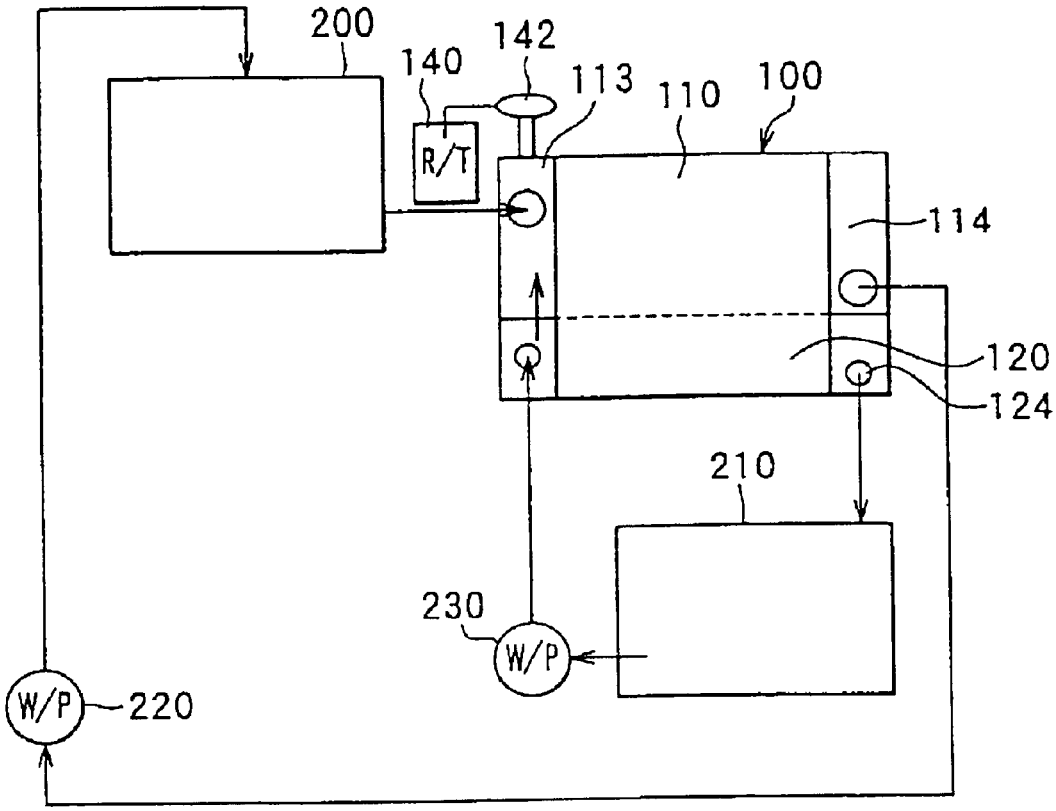
FIG. 6 is a block diagram showing a coolant circuit of the double heat exchanger according to the second embodiment.

A second preferred embodiment of the present invention will be described with reference to FIGS. 5 and 6. In this and following embodiments, components which are substantially the same as those in previous embodiments are assigned the same reference numerals.

In the first embodiment, as shown in FIG. 3, a circuit of engine coolant and a circuit of electronic-parts coolant are independent from each other. In the second embodiment, as shown in FIG. 5, a communication hole 131a is formed in the partition wall 131 disposed between the first radiator inlet tank 113 and the second radiator inlet tank 123 so that the first radiator inlet and outlet tanks 113, 114 communicate with the second radiator inlet and outlet tanks 123, 124. As a result, as shown in FIG. 6, the second filler hole 143 and the second reserve tank 141 of the second radiator 120 of the first embodiment are omitted. Therefore, the number of parts of the heat exchanger 100 is reduced, and a manufacturing cost of the heat exchanger 100 is reduced.

Third Embodiment

Figure 7:
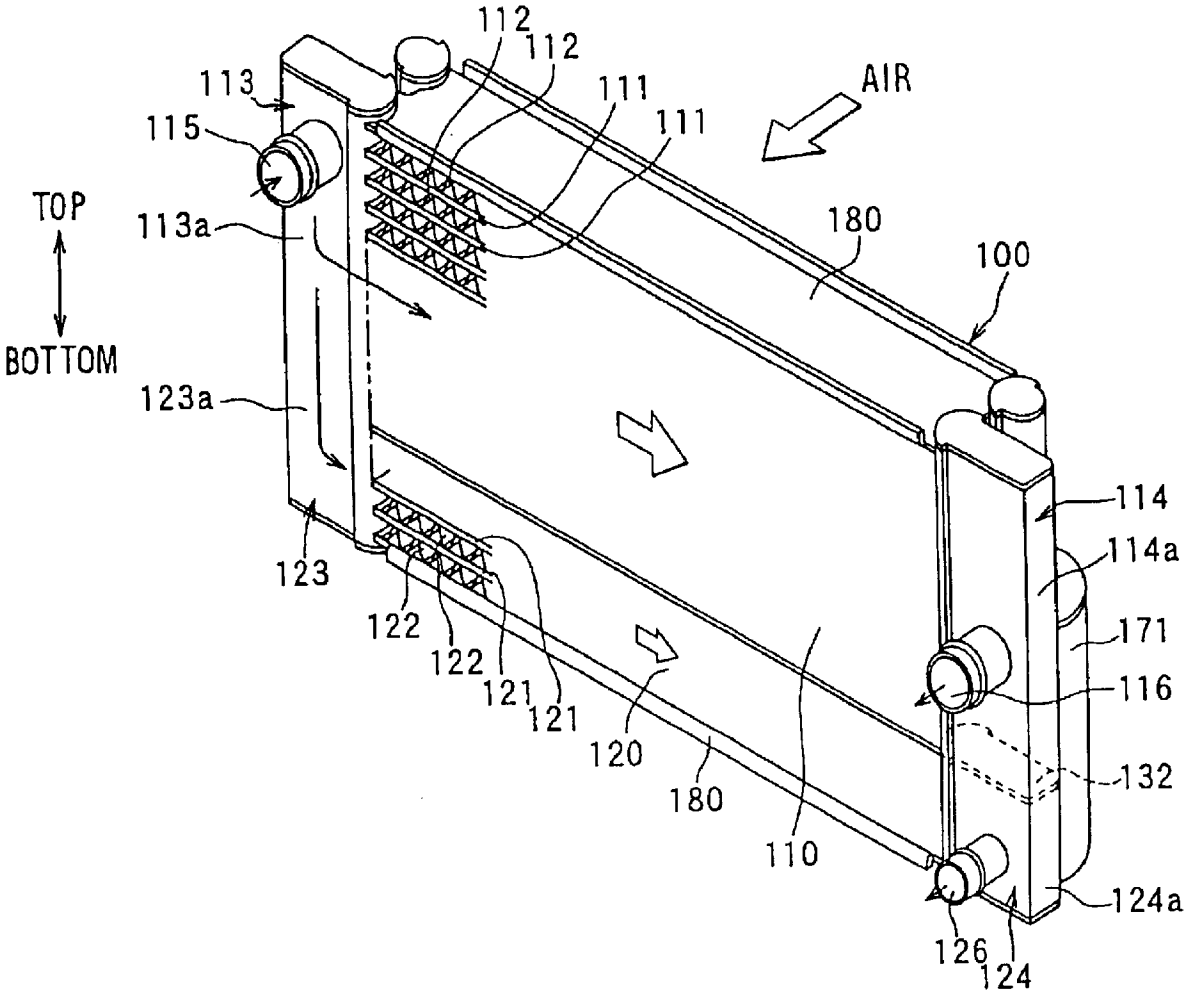
FIG. 7 is a schematic perspective view showing a double heat exchanger for a vehicle air conditioner according to a third preferred embodiment of the present invention.
Figure 8:
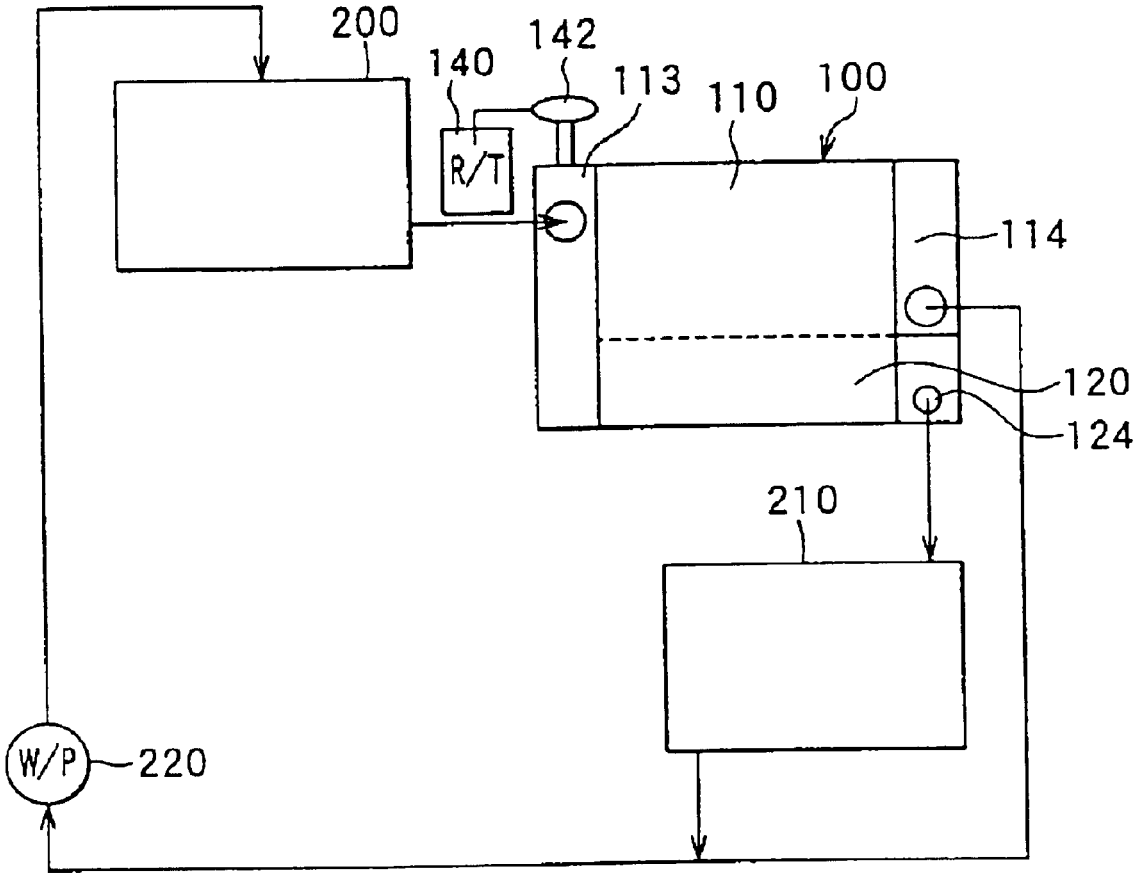
FIG. 8 is a block diagram showing a coolant circuit of the double heat exchanger according to the third embodiment.

A third preferred embodiment of the present invention will be described with reference to FIGS. 7 and 8. In the third embodiment, as shown in FIG. 7, the partition wall 131 and the inlet 125 of the second radiator 120 of the first embodiment are omitted. Therefore, coolant introduced from the inlet 115 flows into the first radiator inlet tank 113 and the second radiator inlet tank 123. As a result, as shown in FIG. 8, the second filler hole 143 and the second reserve tank 141 of the second radiator 120 of the first embodiment are omitted, thereby reducing the number of parts of the heat exchanger 100 and a manufacturing cost of the heat exchanger 100. Further, the second water pump 230 is also omitted. As a result, the number of parts of the vehicle is reduced and a mounting efficiency of the heat exchanger 100 to the vehicle is improved.

Fourth Embodiment

Figure 9:
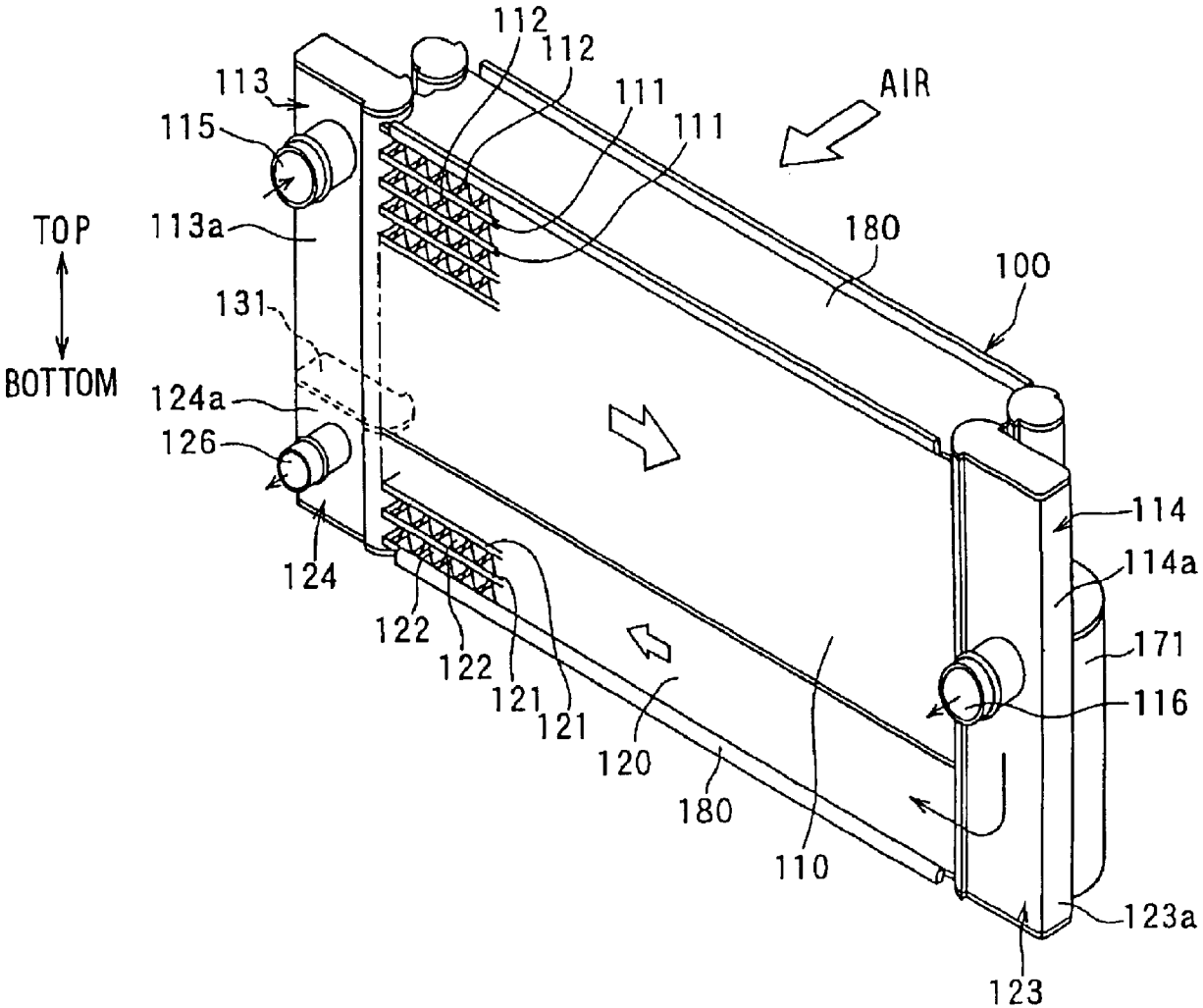
FIG. 9 is a schematic perspective view showing a double heat exchanger for a vehicle air conditioner according to a fourth preferred embodiment of the present invention.

A fourth preferred embodiment of the present invention will be described with reference to FIG. 9. In the fourth embodiment, as shown in FIG. 9, the second radiator outlet tank 124 is disposed below the first radiator inlet tank 113, and the second radiator inlet tank 123 is disposed below the first radiator outlet tank 114. The first radiator inlet tank 113 is separated from the second radiator outlet tank 124 by the partition wall 131. The first radiator outlet tank 114 communicates with the second radiator inlet tank 123. The inlet 125 of the second radiator 120 of the first embodiment is omitted.

As a result, engine coolant introduced into the first radiator 110 from the inlet 115 is cooled in the first radiator 110 and is mostly discharged from the outlet 116 of the first radiator 110. However, a part of engine coolant flowing through the first radiator 110 flows into the second radiator 120 while making a U-turn between the first radiator outlet tank 114 and the second radiator inlet tank 123, and is discharged from the outlet 126 of the second radiator 120. As a result, electronic-parts coolant is cooled by both the first and second radiators 110, 120, and a temperature of electronic-parts coolant is further decreased. A flow rate of engine coolant is controlled by adjusting a size and a position of the outlet 116 of the first radiator 110. A temperature of electronic-parts coolant is controlled by adjusting an amount of engine coolant flowing from the first radiator 110 to the second radiator 120 while making a U-turn between the first radiator outlet tank 114 and the second radiator inlet tank 123.

Fifth Embodiment

Figure 10:
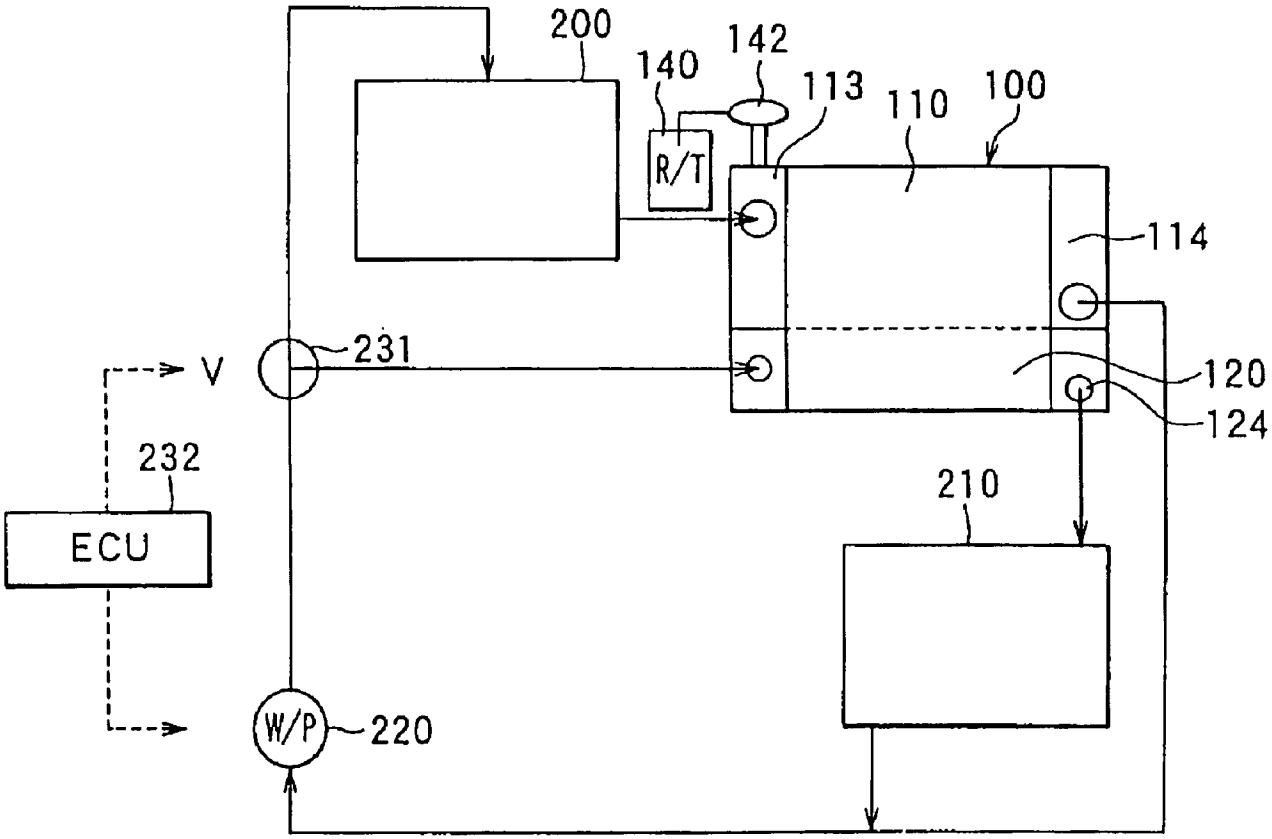
FIG. 10 is a block diagram showing a coolant circuit of a double heat exchanger for a vehicle air conditioner according to a fifth preferred embodiment of the present invention.

A fifth preferred embodiment of the present invention will be described with reference to FIG. 10. In the fifth embodiment, as shown in FIG. 10, the second water pump 230 of the first embodiment is omitted, and coolant discharged from the first water pump 220 is distributed to the first radiator 110 and the second radiator 120. A ratio between an amount of coolant supplied to the first radiator 110 and an amount of coolant supplied to the second radiator 120 is adjusted by a valve 231. In the fifth embodiment, the first water pump 220 is electrically driven, and the first water pump 220 and the valve 231 are controlled by an electronic control unit (ECU) 232.

In the above-mentioned embodiments, the condenser 170 may be replaced by a radiator of a supercritical refrigeration cycle in which a high pressure of refrigerant exceeds a critical pressure of refrigerant, such as a refrigeration cycle through which carbon dioxide flows. In such a case, since refrigerant is not condensed in the radiator, the second radiator 120 is preferably disposed at a downstream air side of the radiator to be opposite a portion of the radiator which accommodates a downstream flow of refrigerant. Further, the first and second radiators 110, 120 and the condenser 170 may be separately formed as long as the first and second radiators 110, 120 and the condenser 170 are arranged as mentioned above in the heat exchanger 100.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A heat exchanger comprising:

a first heat exchanger having a first core portion performing heat exchange between a first fluid flowing through the first heat exchanger and air passing through the first heat exchanger the first heat exchanger being an engine radiator for cooling the first fluid to be introduced into an engine;

a second heat exchanger having a second core portion performing heat exchange between a second fluid flowing through the second heat exchanger and air passing through the second heat exchanger to cool the second fluid, the second heat exchanger being an inverter radiator for cooling the second fluid to be introduced into an inverter;

a third heat exchanger disposed at an upstream air side of the first and second heat exchangers, the third heat exchanger being a condenser having a third core portion for cooling and condensing high temperature refrigerant by performing heat exchange between the refrigerant flowing therethrough and air, the third core portion having a cooling part and a super-cooling part downstream of the cooling part in a refrigerant flow of the third core portion;

a receiver for separating refrigerant from the cooling part into gas refrigerant and liquid refrigerant, the receiver being disposed between the cooling part and the super-cooling part in a refrigerant flow such that the liquid refrigerant is introduced to the super-cooling part, wherein:

the first core portion, the second core portion and the third core portion are disposed in such a manner that the refrigerant flows through the third core portion approximately in parallel with the first fluid flowing through the first core portion and the second fluid flowing through the second core portion;

the first core portion has a core area that is set larger than that of the second core portion;

the cooling part of the third core portion has a core area that is set larger than that of the super-cooling part of the third core portion;

the second core portion is disposed opposite to the super-cooling part of the third core portion;

the first heat exchanger includes a first inlet pipe through which the first fluid from the engine flows into the first core portion and a first outlet pipe through which the first fluid from the first core portion flows out of the first heat exchanger;

the second heat exchanger includes a second inlet pipe through which the second fluid from the inverter flows into the second core portion and a second outlet pipe through which the second fluid from the second core portion flows out of the second heat exchanger; and the first core portion is disposed opposite to the cooling part of the third core portion.

2. The heat exchanger according to claim 1, wherein the first, second and third heat exchangers are integrally formed.

3. The heat exchanger according to claim 1, wherein:

the first core portion includes a plurality of first tubes through which the first fluid flows, and a plurality of first corrugated fins laminated with the first tubes alternately;

the first heat exchanger further includes a first tank disposed for introducing the first fluid into the first tubes or for collecting the first fluid flowing from the first tubes;

the second core portion includes a plurality of second tubes through which the second fluid flows, and a plurality of second corrugated fins laminated with the second tubes alternately;

the second heat exchanger further includes a second tank disposed for introducing the second fluid into the second tubes or for collecting the second fluid flowing from the second tubes;

the first tank and the second tank are constructed by a tank member integrally and continuously extending in an extending direction, and are separated from each other by a partition member in the tank member; and the partition member is disposed at a position approximately equal to a boundary defining the super-cooling part of the third heat exchanger in the extending direction.

4. The heat exchanger according to claim 1, wherein:

the first core portion includes a plurality of first tubes through which the first fluid flows, and a plurality of first corrugated fins laminated with the first tubes alternately;

the second core portion includes a plurality of second tubes through which the second fluid flows, and a plurality of second corrugated fins laminated with the second tubes alternately;

each of the cooling part and the super-cooling part of the third core portion includes a plurality of third tubes through which the refrigerant fluid flows, and a plurality of third corrugated fins laminated with the third tubes alternately;

the first tubes and the second tubes are disposed in parallel with the third tubes; and each of the first tubes and the second tubes has a length approximately equal to that of the third tubes.

5. The heat exchange device according to claim 1, wherein:

the first heat exchanger has a plurality of first tubes through which the first fluid flows, a first inlet tank disposed at a first flow-path end of the first tubes to distribute the first fluid to each of the first tubes and a first outlet tank disposed at a second flow-path end of the first tubes to collect the first fluid having been heat-exchanged with air therein;

the second heat exchanger has a plurality of second tubes through which the first fluid flows, a second inlet tank disposed at a first flow-path end of the second tubes to distribute the first fluid to each of the second tubes and a second outlet tank disposed at a second flow-path end of the second tubes to collect the first fluid having been heat-exchanged with air therein; and the first and second heat exchangers are integrally formed through at least one of an integration of the first and second inlet tanks and an integration of the first and second outlet tanks.

6. The heat exchanger according to claim 1, wherein the second core portion is disposed opposite to substantially all of the super-cooling part of the third core portion.

7. A heat exchanger comprising:

a first heat exchanger having a first core portion performing heat exchange between a first fluid flowing through the first heat exchanger and air passing through the first heat exchanger to cool the first fluid;

a second heat exchanger having a second core portion performing heat exchange between a second fluid flowing through the second heat exchanger and air passing through the second heat exchanger to cool the second fluid;

a third heat exchanger disposed at an upstream air side of the first and second heat exchangers, the third heat exchanger having a third core portion performing heat exchange between a third fluid flowing through the third heat exchanger and air passing through the third heat exchanger to cool the third fluid, the third heat exchanger having a first section through which the third fluid flows in a first direction and a second section through which the third fluid flows in a second direction, the second direction being opposite to and parallel with the first direction; wherein the first heat exchanger is disposed opposite to the first section of the third heat exchanger in an air flow direction and the second heat exchanger is disposed opposite to the second section of the third heat exchanger in the air flow direction; and the second section has a core area smaller than a core area of the first section.

8. The heat exchanger according to claim 7 wherein the third fluid flows from the first section to the second section.

* * * * *